United States Patent [19]

Theurer

[11] Patent Number: 4,939,998

[45] Date of Patent: Jul. 10, 1990

[54] BALLAST TAMPING MACHINE

[75] Inventor: Josef Theurer, Vienna, Austria

[73] Assignee: Fran Plasser Bahnbaumaschinen-Industriegesellschaft m.b.H., Vienna, Austria

[21] Appl. No.: 165,510

[22] Filed: Mar. 8, 1988

[30] Foreign Application Priority Data

Jul. 23, 1987 [AT] Austria ..... 18774

[51] Int. Cl.[5] ..... B61D 15/00

[52] U.S. Cl. ..... 104/12; 104/9

[58] Field of Search ..... 104/2, 7.1, 7.2, 8, 104/9, 10, 12, 279

[56] References Cited

U.S. PATENT DOCUMENTS

| | | | |
|---|---|---|---|
| 1,595,420 | 8/1926 | Robb . | |
| 2,596,823 | 5/1952 | Richardson | 104/2 |
| 2,996,016 | 8/1961 | Keller | 104/12 |
| 3,537,400 | 11/1970 | Taylor . | |
| 3,589,298 | 6/1971 | Plasser et al. | 104/12 |
| 4,165,694 | 8/1979 | Theurer . | |
| 4,421,034 | 12/1983 | Allmer . | |
| 4,476,786 | 10/1984 | Theurer . | |
| 4,534,295 | 8/1985 | Theurer . | |

*Primary Examiner*—Margaret A. Focarino
*Assistant Examiner*—Joseph D. Pape
*Attorney, Agent, or Firm*—Kurt Kelman

[57] ABSTRACT

In a mobile machine for tamping ballast under ties of a railroad track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools, the invention provides a vertically adjustable device associated with the ballast tamping assembly for gripping and transversely positioning a respective one of the ties, and a drive for vertically adjusting the device. A vertically adjustable ballast broom device preferably precedes the tamping tool assembly for sweeping ballast off respective ones of the ties into an adjacent crib defined between successive ones of the ties.

6 Claims, 2 Drawing Sheets

BALLAST TAMPING MACHINE

BACKGROUND OF THE INVENTION

1. Field of the Invention

The present invention relates to a mobile machine for tamping ballast under ties of a railroad track, which comprises a machine frame and spaced undercarriages supporting the machine frame for mobility on the railroad track in an operating direction. The ballast tamping machine has a ballast tamping assembly comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocatings the tamping tools.

2. Description of the Prior Art

The ties of a railroad track consisting of two rails fastened to the ties must rest on a well tamped ballast support so that the track retains its desired level and line whereby the quality and the life of the track is enhanced and extended. For this purpose, mobile track tampers of the above-indicated type are used to tamp the ties with tamping tools immersed in the ballast at each longitudinal side of the tie to the left and the right of each rail while the tamper advances intermittently from tamping stage to tamping stage or, in a more recent development of the art, continuously. Preferably, the track is leveled and lined at the same time so that the ties are tamped when the track is in a desired position. U.S. Pat. No. 4,534,295, dated Aug. 13, 1985, discloses a track tamping, leveling and lining operating unit incorporating such a ballast tamping assembly and a track leveling and lining assembly, which comprises a common carrier frame supporting the assemblies, a rear end of the carrier frame being supported on flanged wheels on the railroad track while a front end is linked to a track working machine. However, many types of smaller ballast tamping machines without leveling and lining tools and reference systems are known for minor track rehabilitation work. One such machine having ballast tamping assemblies of the above-indicated type associated with each rail has been disclosed in U.S. Pat. No. 4,476,786, dated Oct. 16, 1984.

U.S. Pat. No. 4,165,694, dated Aug. 28, 1979, discloses a mobile track leveling, lining and tamping machine which is preceded by a ballast plow arranged to move ballast from the shoulders into the cribs so that there will be sufficient ballast available for the succeeding tamping tools to tamp under the ties whereby a high-quality ballast support is provided for the corrected track. Whether large or small tampers are used and whether the tampers have a relatively high or low efficiency and accuracy, ballast plows have often been used in conjunction therewith, in many instances on independent, self-propelled vehicles. With smaller tamping machines, it is often uneconomical to use relatively large and expensive independent ballast plow machines.

During track rehabilitation work including tie tamping, it has been common practice to replace damaged or mispositioned ties, whose spikes have become loose, by withdrawing such ties from the track and inserting new and properly positioned ties.

SUMMARY OF THE INVENTION

It is the primary object of this invention to provide a ballast tamping machine of the first-indicated type with the capability of transversely positioning a respective one of the ties so that it may be in the proper position before it is tamped.

It is another object of the invention to provide such a machine with means for moving additional ballast to the tamping tools whereby an adequate amount of ballast is available for tamping.

The above and other objects are accomplished in such a mobile ballast tamping machine according to the present invention by combining it with a vertically adjustable device associated with the ballast tamping assembly for gripping and transversely positioning the tie, and a drive for vertically adjusting the tie gripping and positioning device. Preferably, the ballast tamping machine further comprises a vertically adjustable ballast broom device arranged for sweeping ballast off respective ones of the ties into an adjacent crib defined between successive ties, and a drive for vertically adjusting the broom device.

According to another aspect of this invention, there is provided an operating unit comprising a tool carrier frame, an undercarriage with flanged wheels supporting one end of the tool carrier frame on the railroad track, a vertically adjustable ballast broom device arranged for sweeping ballast off respective ones of the ties into an adjacent crib defined between successive ones of the ties, a ballast tamping assembly mounted on the tool carrier frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools, the ballast tamping assembly succeeding the ballast broom device in the operating direction, and drive means for vertically adjusting the broom device. A drive connects an opposite end of the tool carrier frame to the machine frame for longitudinally displacing the tool carrier frame relative to the machine frame.

Such a ballast tamping machine incorporating a vertically adjustable tie gripping and positioning device is particularly useful as the last stage of a tie replacement operation in which preceding tie exchange devices have removed old ties and replaced them with new ties, these newly inserted ties then being properly positioned before they are tamped. However, it may also be effectively used during a tie tamping operation when a damaged tie or a tie whose spikes have become loose and which, therefore, has been displaced is discovered. In this case, such a tie may be properly repositioned before tamping or even be entirely withdrawn and replaced by a new tie before tamping. Particularly where only a few ties are damaged or mispositioned, the ballast tamping machine of the invention will be very effective since it does away with the expensive use of a complex tie replacement apparatus. The properly positioned tie may be immediately tamped in a single operating stage. The ballast broom device enables the ballast to be distributed in the cribs to assure uniform and effective tamping as well as a leveling of the ballast in the cribs. Thus, the machine is particularly well adapted for the rapid and efficient repair of suddenly appearing minor track damage during relatively short intervals between passing trains. Since the tie gripping and positioning device is associated with the ballast tamping assembly, it may be viewed and operated from the same operator's cab or seat.

The operating unit of the invention may be advantageously arranged in an upwardly recessed portion of the machine frame of a work vehicle used in a continuously advancing tie replacement train. Since the tool carrier frame of the unit is longitudinally displaceably connected to the work vehicle machine frame, it may be briefly held stationary during the tamping operation while the work vehicle continues to advance. After the tamping operation has been completed, the longitudinal displacement drive is actuated for rapidly displacing the unit into its intitial forward position.

The above and other objects, advantages and features of this invention will become more apparent from the following detailed description of certain now preferred embodiments thereof, taken in conjunction with the accompanying, somewhat schematic drawing.

DESCRIPTION OF THE PREFERRED EMBODIMENTS

Figure 1:
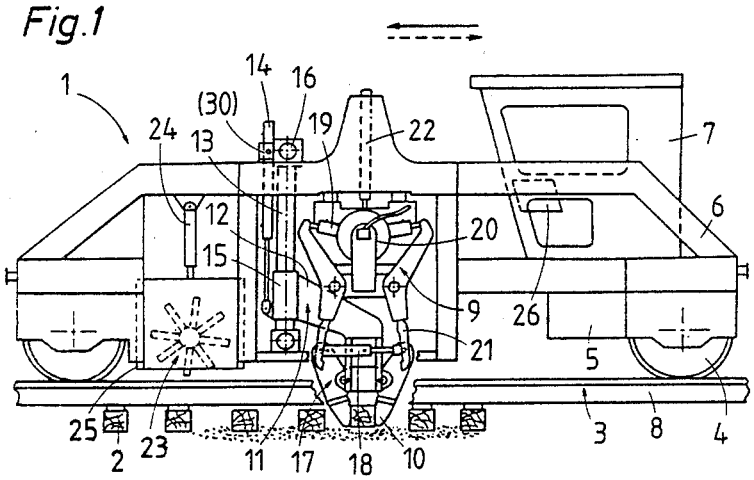
FIG. 1 is a side elevational view of one embodiment of the mobile ballast tamping machine with a tie gripping and positioning device and a preceding ballast broom device according to the present invention.
Figure 2:
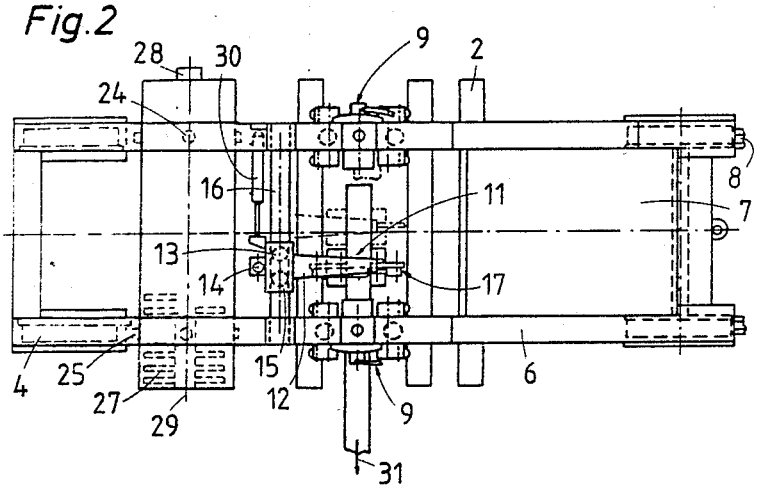
FIG. 2 is a top view of FIG. 1.

Referring now to the drawing and first to FIGS. 1 and 2, there is shown mobile machine 1 for tamping ballast under ties 2 of railroad track 3. The machine comprises machine frame 6 and spaced undercarriages 4 supporting the machine frame for mobility on railroad track 3 in an operating direction. The machine has its own drive 5 and carries operator's cab 7. Respective ballast tamping assembly 9 is associated with each rail 8 of track 3. Each ballast tamping assembly is mounted on machine frame 6 and comprises a tamping tool carrier vertically adjustable on the machine frame by drive 22, pairs of vibratory and reciprocatory tamping tools 21 immersible in the ballast upon vertical adjustment of the tamping tool carrier, and drives 19, 20 for vibrating and reciprocating the tamping tools. All of this structure is conventional. According to the invention, vertically adjustable device 11 for gripping and transversely positionining a respective tie 2 is associated with ballast tamping assembly 9 and drive 14 is arranged for vertically adjusting the device.

As shown in the drawing, device 11 comprises adjustable tie gripping elements consisting of pivotal clamps 10 constituting tie gripping means 17 and drive means 18 linking the clamps for adjusting them between a tie gripping and release position. Tie clamps 10 and drive means 18 are mounted on carrier body 12 and guide body 15 is affixed to the carrier body, the carrier body extending obliquely from the guide body to the clamps and drive means in a vertical plane. Respective guide posts 13 and 16 extend vertically and transversely for guidingly supporting guide body 15 for vertical and transverse adjustment. Vertical adjustment drive 14 is a cylinder-piston drive whose cylinder is affixed to an upper portion of guide body 15 and further drive 30 is connected to the guide body for transverse adjustment thereof, the adjusting drives connecting the guide body to machine frame 6. The vertical and transverse adjustability of tie gripping means 17 provides great mobility and adaptability to the device for gripping the tie and for displacing it transversely with respect to the railroad track for proper positioning of the tie, the reaction forces generated by the tie displacement being advantageously transmitted to the robust machine frame of the machine. Depending on the length of the transverse displacement path, an old tie may be withdrawn completely from the track and a new tie gripped and inserted in its place whereby the tie positioning device becomes a tie replacement device. The oblique extension of the carrier body enables the rigid guide posts to be connected to the machine frame ahead of the ballast tamping assemblies in the operating direction so that the adjustment of the tie gripping and positioning device will not interfere with the tamping tools. Furthermore, the projecting arrangement of the tie clamps enables the operator to view the tie gripping operation freely.

Tie gripping and positioning device 11 is mounted on the machine frame between ballast tamping assemblies 9, pivotal tie gripping clamps 10 and the pairs of tamping tools 21 being arranged symmetrically with respect to a vertical plane of symmetry extending transversely of railroad track 3. The symmetric arrangement of the tie gripping clamps and tamping tools assures the automatic centering of the tamping tools with respect to the gripped and repositioned tie. The arrangement of the tie gripping and positioning device between the ballast tamping assemblies makes it possible for an operator in cab 7 to monitor the tie positioning and tie tamping operations.

As shown in FIGS. 1 and 2, a vertically adjustable ballast broom device 23 is arranged on the machine frame for sweeping ballast off respective ties 2 into an adjacent crib defined between successive ties, and drive 24 links the ballast brrom device to machine frame 6 for vertically adjusting the broom device along vertical guide 25. The broom device precedes the ballast tamping assembly in the operating direction, being mounted on the machine frame between the ballast tamping assembly and tie gripping and positioning device 11. As shown in FIG. 2, broom device 23 comprises rotary ballast broom 27 extending over the width of the railroad track and rotatable about horizontal axis 29 extending transversely thereto, and drive 28 for rotating the broom. Drive 5 on the machine frame makes machine 1 self-propelled. All the drives on the machine are remote-controlled from control panel 26 in operator's cab 7. A self-propelled machine with such a ballast broom arrangement enables ballast to be removed from the ties and to be smoothed in the succeeding cribs, or to have excess ballast to be swept into the next crib so that there is always a uniform amount of ballast available for tamping.

The operation of machine 1 will be described hereinbelow in connection with an operation in which tie gripping and positioning device 11 is used for withdrawing an old tie and inserting a new tie:

As soon as an operating site has been reached by the machine, drive 5 is actuated to propel machine frame 6 into a position wherein tie clamps 10 are centered in relation to tie 2 to be pulled. At the same time, drive 30 is actuated to move tie gripping and positioning device 11 laterally into a position shown in dash-dotted lines, which is opposite to the tie withdrawal direction indicated by arrow 31. While tie clamps 10 are spread apart, drive 14 is actuated to lower tie gripping means 17 to the level of the tie and adjustment drive 18 is then actuated to pivot the tie clamps into clamping engagement with the tie. Drive 30 is then actuated to move the gripped tie in the direction of arrow 31 until tie gripping and positioning device 11 has withdrawn tie 2 laterally from track 3 to a position in which tie gripping means 11 is immediately adjacent ballast tamping assembly 9. At this point, tie clamps are opened again and the tie gripping and positioning device is retracted into the end position shown in dash-dotted lines. The device is then actuated again to withdraw the tie further and this operation is repeated until the tie has been withdrawn from track 3 to a lateral position whence it may be readily removed by operating personnel on the shoulder of the track. Immediately thereafter, the same tie gripping and positioning device may be used for the insertion of a new tie simply by reversing the direction of lateral adjustment of the device. For this purpose, the operating personnel will take a new tie stored on the track shoulder and will place it in the space just evacuated by the withdrawn tie so that a leading end of the new tie comes to rest in a position wherein the tie clamps may engage it, possibly after displacing any excess ballast from this space to the adjacent cribs, whereupon tie gripping and positioning device 11 is operated in the reverse direction until the new tie has been fully inserted in track 3.

If there is no need for a tie replacement and a loose tie has merely become misoriented, it is only necessary to actuate drive 30 of tie gripping means 17 to grip the tie and to actuate drive 5 to propel the machine frame until the tie has assumed its correct transverse position for subsequent tamping.

In a further operating stage, drive 28 is actuated to rotate ballast broom 27 and, after drive 24 is actuated to lower ballast broom device 23 onto tie 2, drive 5 is actuated to propel machine 1 toward the newly inserted or properly positioned tie. During this movement of the machine, the ballast is swept from the cribs alongside the longitudinal edges of the newly inserted or properly positioned tie and any ballast on this tie is swept off it. Subsequently, ballast broom device is raised and machine 1 is propelled in the operating direction until tamping tools 21 of ballast tamping assemblies 9 are centered over the newly inserted or properly positioned tie. Drives 22 are now actuated to lower the tamping assemblies for immersion of the tamping tools in the ballast and tamping tool reciprocating and vibrating drives 19, 20 are actuated to tamp the ballast under the tie. The tie may be fastened to rails 8 either before or after tamping, for example by driving fastening spikes into the tie.

It is also possible to use tie gripping and positioning device 11 of machine 1 merely for the final stage of a tie insertion in a tie replacement installation in which groups of, say, three adjacent ties are replaced in an existing track, in which installation a tie insertion device has partially inserted a group of new ties and tie gripping and positioning device 11 only accomplishes the final stage of the insertion and proper positioning of the new ties. Such a tamping machine at the end of a tie replacement apparatus is of particular value when the apparatus is used for replacing a considerable number of groups of ties in a long stretch of existing track. Such an apparatus has been disclosed, for example, in the copending patent application filed simultaneously by Josef Theurer and Herbert Worgotter, entitled "Mobile Tie Gang Apparatus and Tie Exchange Method".

Machine 1 may also be used simply for sequentially tamping consecutive ties 2 of track 3, for example following a track leveling, lining and tamping machine. On the other hand, used alone, a work crew may precede the machine to note damaged or loose ties. The spikes will be removed from such ties and they will preferably be marked so that the operator in cab 7 will be able to notice them as the tamping machine advances from tie to tie. Upon noticing a marked tie, the operator will interrupt the tamping operation and will operate tie gripping and positioning device 11 in the above-indicated manner either to replace the damaged tie or to position the misoriented tie properly, whereupon the tamping operation is resumed.

Figure 3:
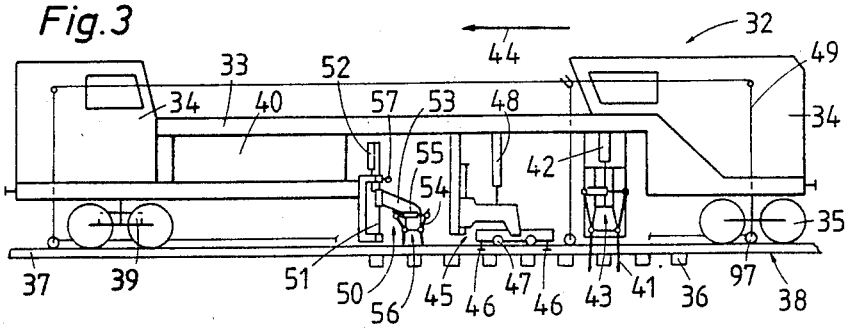
FIG. 3 is a side elevational view of a track leveling, lining and tamping machine with ballast tamping assemblies preceded by a tie gripping and positioning device.

FIG. 3 illustrates mobile track leveling, lining and tamping machine 32 comprising machine frame 33, spaced undercarriages 35 supporting the machine frame for mobility on railroad track 38 in an operating direction indicated by arrow 44. Drive 39 propels the machine and the machine frame carries operator's cab 34 at a rear end thereof and power plant 40 at a front end for supplying power to the operating drives of the machine. Ballast tamping assembly 43 is mounted on machine frame 3 and comprises a vertically adjustable tamping tool carrier, drive 42 vertically adjusting the tamping tool carrier. Pairs of vibratory and reciprocatory tamping tools 41 are immersible in the ballast upon vertical adjustment of the tamping tool carrier and drives are provided for vibrating and reciprocating the tamping tools. Vertically adjustable device 50 for gripping and transversely positioning a respective tie 36 of the track is associated with the ballast tamping assembly, tie gripping and positioning device 50 and tamping assembly 43 being mounted sequentially in the operating direction on machine frame 33 between undercarriages 35. Drive 52 vertically adjusts the tie gripping and positioning device. Track leveling and lining system 49 and track lifting and lining unit 45 controlled by the system are mounted on machine frame 33. Unit 45 is arranged immediately preceding the ballast tamping assembly and comprises lifting and lining tools 46, 47 engaging rails 37 of track 38. Lifting drive 48 connects unit 45 to the machine frame. As shown, tie gripping and positioning device 56 and track lifting and lining unit 45 are arranged sequentially in the operating direction, unit 45 being mounted between device 56 and ballast tamping assembly 43.

The tie gripping and positioning device comprises vertically adjustable and obliquenly downwardly extending carrier body 53 whose lower end carries tie gripping means 54 comprising tie clamps 56 operated by drive 56. Drive 57 is connected to carrier body 53 for transversely displacing the carrier body with the tie gripping means. The sequential arrangement of the tie gripping and positioning device, the track lifting and lining unit and the ballast tamping assembly enable the ties to be tamping immediately after they have been properly positioned in a leveled and lined position.

Figure 4:
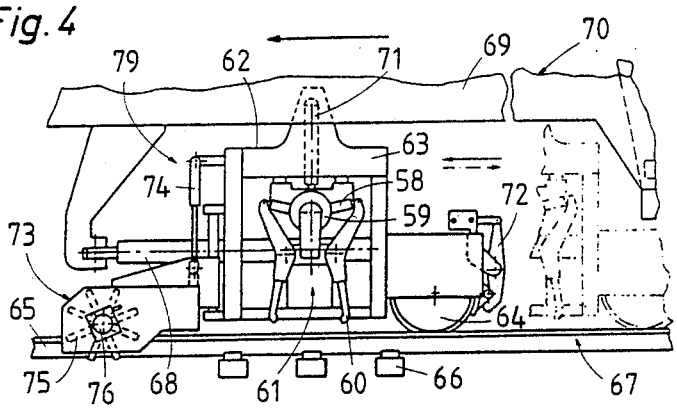
FIG. 4 is a side elevational view of an operating unit according to one aspect of the invention, which is arranged in an upwardly recessed portion of a machine frame of a work vehicle which may form part of a continuously advancing tie replacement train.
Figure 5:
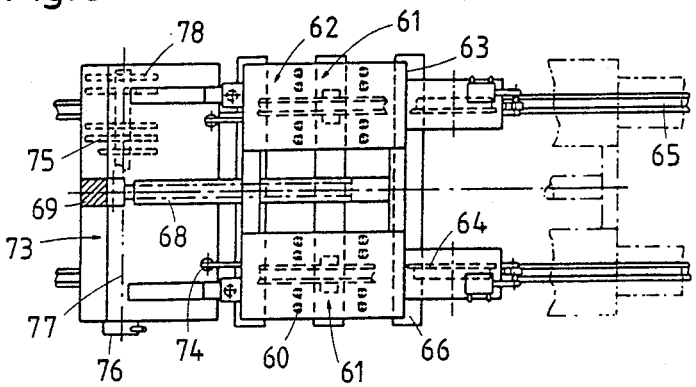
FIG. 5 is a top view of FIG. 4.

FIGS. 4 and 5 illustrate an operating unit 62 useful for incorporation in a continuously advancing mobile tie replacement apparatus 70, such as disclosed and claimed in the above-identified, simultaneously filed patent application. The operating unit comprises tool carrier frame 63 and undercarriage 64 with flanged wheels supporting one end of the tool carrier frame on railroad track 67 consisting of rails 65 fastened to ties 66. It further comprises vertically adjustable ballast broom device 73 arranged for sweeping ballast off respective ties into an adjacent crib defined between successive ties, drive means 74 for vertically adjusting the broom device, and ballast tamping assembly 61. The ballast tamping assembly comprises a vertically adjustable tamping tool carrier, drive 71 for vertically adjusting the tamping tool carrier, pairs of vibratory and reciprocatory tamping tools 60 immersible in the ballast upon vertical adjustment of the tamping tool carrier, and drives 58, 59 for reciprocating and vibrating the tamping tools. The ballast tamping assembly succeeds the ballast broom device in the operating direction. Drive 68 connects an opposite end of tool carrier frame 63 to machine frame 69 for longitudinally displacing the tool carrier frame relative to the machine frame. This opposite tool carrier frame end is formed by a central pole. As shown in FIG. 4, machine frame 69 has an upwardly recessed portion between the undercarriages (not shown) supporting the respective ends of the machine frame for mobility on railroad track 67, operating unit 62 being arranged in the recessed machine frame portion. Also, as in the embodiment of FIGS. 1 and 2, the machine frame may carry a drive whereby the machine is self-propelled. Supporting undercarriage 64 of tool carrier frame 63 has its own brake system 72. As shown in FIG. 5, the ballast broom device comprises rotary ballast broom 75 rotatable about horizontal axis 77 by drive 76 and extending across track 67. The broom has tubular sweeping elements 78 projecting radially from broom axis 77.

Such a longitudinally displaceable operating unit housed in an upwardly recessed machine frame portion of a machine 79 incorporated into a continuously advancing tie replacement apparatus enables effective tamping of the newly inserted ties to be effected intermittently while the apparatus proceeds non-stop along the track. Before tamping, ballast broom device 73 is lowered by drive means 74 until broom 75 contacts ties 66 and the broom is rotated to sweep the ballast into the adjacent crib. After tamping the tie, the ballast broom device may be lifted or, if desired, it may remain in its lowered position while mobile apparatus 70 continuously advances. As sketchily indicated at the right of FIG. 4, the entire operation of the tools on unit 62 may be controlled by an operator in a cab within view of the unit. After completing the tamping of each tie, drive 68 is actuated for rapidly displacing the unit from its rear position shown in dash-dotted lines to its forward position in which the tamping of the next tie is initiated.

Figure 6:
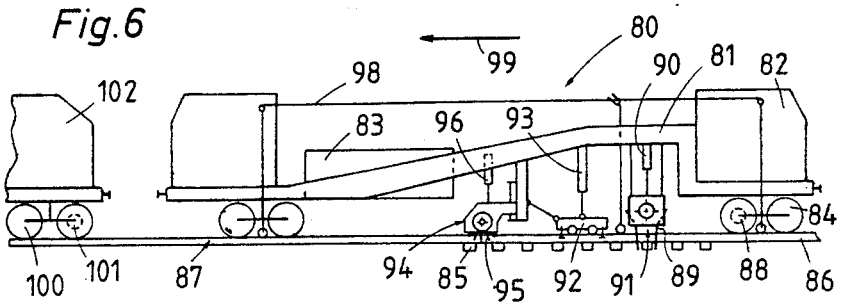
FIG. 6 is a side elevational view of a track leveling, lining and tamping machine with a ballast broom device preceding the ballast tamping and track lifting and lining assemblies.

FIG. 6 illustrates track leveling, lining and tamping machine 80 incorporating ballast broom device 94. The machine has frame 81 carrying operator's cab 82 and power plant 83. Undercarriages 84 support the machine frame. Drive 88 propels the machine along railroad track 87 consisting of rails 86 fastened to ties 85 in an operating direction indicated by arrow 99. Vertically adjustable ballast tamping assembly 91 having pairs of vibratory and reciprocatory tamping tools 89 is mounted on machine frame 81 between undercarriages 84 and vertical adjustment drive 90 connects the ballast tamping assembly to the machine frame. Furthermore, track lifting and lining unit 92 is connected to machine frame 81 by vertical adjustment drive 93, preceding the ballast tamping assembly in the operating direction. Vertically adjustable ballast broom device 94 comprising rotary ballast broom 95, in turn, precedes ballast tamping assembly 91 and track lifting and lining unit 92, and vertical adjustment drive 96 connects the ballast broom device to the machine frame for vertical adjustment thereof along a vertical guide. Track leveling reference system 98, which controls the operation of track leveling by unit 92, is supported on railroad track 87 by rail sensing rollers 97. As fragmentarily indicated at the left of FIG. 6, track leveling, lining and tamping machine 80 is preceded by a ballast cleaning machine 102 supported by undercarriages 100 on track 87 and propelled therealong by drive 101.

Such a track leveling, lining and tamping machine advancing intermittently from tie to tie is particularly adapted for use with a continuously advancing ballast cleaning machine. The ballast broom device sweeps the redistributed cleaned ballast, some of which rests on the ties and which is not uniformly distributed in the cribs, into the cribs for uniform distribution thereof. If there is excess ballast in one crib, the rotary broom will sweep it over the next tie into the adjacent crib. In this manner, sufficient and substantially uniformly distributed ballast will be available in each crib for tamping under the ties, thus producing uniform and stable tie tamping.

What is claimed is:

1. In a mobile machine for tamping ballast under ties of a railroad track, each of the ties having opposite longitudinal sides extending transversely to the track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools in a direction extending parallel to the track for tamping ballast under respective ones of the ties positioned between the pairs of tamping tools;

(a) a vertically adjustable device associates with the ballast tamping assembly for gripping and transversely displacing and positioning a respective one of the ties, the device comprising
  (1) pivotally adjustable clamps for gripping the longitudinal tie sides and
  (2) drive means for adjusting the clamps,
(b) drives for vertically and transversely adjusting the device, the adjusting drives connecting the device to the machine frame,
(c) a vertically adjustable ballast broom device preceding the ballast tamping assembly in the operating direction and arranged for sweeping ballast off respecitve ones of the ties into an adjacent crib defined between successive ones of the ties, and
(d) a drive for vertically adjusting the broom device.

2. In the ballast tamping machine of claim 1, the broom device comprising a rotary ballast broom extending over the width of the railroad track and rotatable about a horizontal axis extending transversely thereto, and a drive for rotating the broom.

3. In the ballast tamping machine of claim 2, a drive for the machine frame whereby the machine is self-propelled.

4. In a mobile machine for tamping ballast under ties of a railroad track, which comprises a machine frame and spaced undercarriages supporting the machine frame for mobility on the railroad track in an operating direction:

(a) an operating unit comprising
  (1) a tool carrier frame,
  (2) an undercarriage with flanges wheels supporting one end of the tool carrier frame on the railroad track,
  (3) a vertically adjustable ballast broom device arranged for sweeping ballast off respective ones of the ties into an adjacent crib defined between successive ones of the ties,
  (4) a ballast tamping assembly mounted on the tool carrier frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools in a direction extending parallel to the track for tamping ballast under respective ones of the ties positioned between the pairs of tamping tools, the ballast tamping assembly succeeding the ballast broom device in the operating direction, and
  (5) drive means for vertically adjusting the broom device, and (b) a drive connecting an opposite end of the tool carrier frame to the machine frame for longitudinally displacing the tool carrier frame relative to the machine frame.

5. In the ballast tamping machine of claim 4, wherein the machine frame has an upwardly recessed portion between the undercarriages, the operating unit is arranged in said recessed machine frame portion, and a drive for the machine frame whereby the machine is self-propelled.

6. In a mobile machine for tamping ballast under ties of a railroad track, each of the ties having opposite longitudinal sides extending transversely to the track, which comprises a machine frame, spaced undercarriages supporting the machine frame for mobility on the railroad track in an operating direction, and a ballast tamping assembly mounted on the machine frame and comprising a vertically adjustable tamping tool carrier, a drive for vertically adjusting the tamping tool carrier, pairs of vibratory and reciprocatory tamping tools immersible in the ballast upon vertical adjustment of the tamping tool carrier, and drives for vibrating and reciprocating the tamping tools in a direction extending parallel to the track for tamping ballast under respective ones of the ties positioned between the pairs of tamping tools;

(a) a vertically adjustable device associates with the ballast tamping assembly for gripping and transversely displacing and positioning a respective one of the ties, the device comprising
  (1) pivotally adjustable clamps for gripping the longitudinal tie sides,
  (2) drive means for adjusting the clamps,
  (3) a carrier body for the clamps and the drive means therefor,
  (4) a guide body affixed to the carrier body, the carrier body extending obliquely from the guide body to the clamps and drive means in a vertical plane, and
  (5) respective guide posts extending vertically and transversely for guidingly supporting the guide body for vertical and transverse adjustment, and (b) drives for vertically and transversely adjusting the guide body, the adjusting drives connecting the guide body of the device to the machine frame.

* * * * *

UNITED STATES PATENT AND TRADEMARK OFFICE

CERTIFICATE OF CORRECTION

PATENT NO. : 4,939,998

DATED : July 10, 1990

INVENTOR(S) : Josef THEURER

It is certified that error appears in the above-identified patent and that said Letters Patent is hereby corrected as shown below:

Cover page, column 1, item [73], delete line 1 in its entirety, and substitute therefor —Franz Plasser—.

Cover page, column 1, item [30], delete line 2 in its entirety, and substitute therefor —Jul. 23, 1987 [AT] Austria A 1874/87—.

Signed and Sealed this

Seventeenth Day of September, 1991

*Attest:*

HARRY F. MANBECK, JR.

*Attesting Officer*

*Commissioner of Patents and Trademarks*